US011365697B2

(12) United States Patent
Nair et al.

(10) Patent No.: US 11,365,697 B2
(45) Date of Patent: Jun. 21, 2022

(54) CONTROLLING AN IMAP OF AN ENGINE USING A VARIABLE GEOMETRY TURBOCHARGER AND AN INTAKE THROTTLE VALVE TO FACILITATE A REGENERATION PROCESS

(71) Applicant: Caterpillar Inc., Peoria, IL (US)

(72) Inventors: Rajesh N. Nair, Mossville, IL (US); Samuel Were, Peoria, IL (US); James Harris Mutti, Germantown Hills, IL (US)

(73) Assignee: Caterpillar Inc., Peoria, IL (US)

( * ) Notice: Subject to any disclaimer, the term of this patent is extended or adjusted under 35 U.S.C. 154(b) by 59 days.

(21) Appl. No.: 16/949,137

(22) Filed: Oct. 15, 2020

(65) Prior Publication Data

US 2022/0120232 A1 Apr. 21, 2022

(51) Int. Cl.

| | |
|---|---|
| ***F02D 41/02*** | (2006.01) |
| ***F02B 37/24*** | (2006.01) |
| ***F02D 41/10*** | (2006.01) |
| ***F02D 41/14*** | (2006.01) |
| ***F02D 41/00*** | (2006.01) |

(52) U.S. Cl.

CPC ..... *F02D 41/027* (2013.01); *F02B 37/24* (2013.01); *F02D 41/0007* (2013.01); *F02D 41/024* (2013.01); *F02D 41/10* (2013.01); *F02D 41/1446* (2013.01); *F02D 2200/0406* (2013.01); *F02D 2200/0614* (2013.01); *F02D 2200/101* (2013.01)

(58) Field of Classification Search

CPC ..... F02B 37/24; F02D 2200/0406; F02D 2200/0614; F02D 2200/101

See application file for complete search history.

(56) References Cited

U.S. PATENT DOCUMENTS

| | | | |
|---|---|---|---|
| 6,272,859 | B1 | 8/2001 | Barnes et al. |
| 6,314,735 | B1 | 11/2001 | Kolmanovsky et al. |
| 6,625,986 | B2 | 9/2003 | Mazaud et al. |
| 6,662,562 | B2 | 12/2003 | Engel et al. |
| 6,672,060 | B1 | 1/2004 | Buckland et al. |
| 6,948,482 | B2 | 9/2005 | Kilkenny et al. |

(Continued)

OTHER PUBLICATIONS

Co-Pending U.S. Appl. No. 16/562,193, entitled "Using a Variable Geometry Turbocharger to Control an Exhaust Gas Temperature and a Pressure of an Intake Manifold," by Were et al., filed Sep. 5, 2019, 31 Pages.

*Primary Examiner* — Ngoc T Nguyen
(74) *Attorney, Agent, or Firm* — Harrity & Harrity LLP

(57) ABSTRACT

A controller may determine that a regeneration process associated with an engine of a machine is active. The controller may obtain, based on determining that the regeneration process is active, information concerning a speed of the engine, information concerning a load of the engine, and information concerning a fuel rate of the engine. The controller may select, based on the information concerning the speed of the engine, the information concerning the load of the engine, and the information concerning the fuel rate of the engine, a control process, of a plurality of control processes, to control an intake manifold absolute pressure (IMAP) of the engine to facilitate the regeneration process. The controller may cause, according to the selected control process, adjustment of one or more components of a variable geometry turbocharger (VGT) of the engine and an intake throttle valve (ITV) of the engine.

20 Claims, 4 Drawing Sheets

(56) References Cited

U.S. PATENT DOCUMENTS

| | | | |
|---|---|---|---|
| 7,658,068 | B2 | 2/2010 | Mulloy et al. |
| 8,151,567 | B2 | 4/2012 | Rollinger et al. |
| 8,752,364 | B2 | 6/2014 | Guo et al. |
| 9,322,363 | B2 | 4/2016 | Kostrzewski |
| 2008/0016853 | A1 | 1/2008 | Zhang et al. |
| 2011/0011081 | A1 | 1/2011 | Quigley et al. |
| 2018/0187615 | A1 | 7/2018 | Lahti et al. |

CONTROLLING AN IMAP OF AN ENGINE USING A VARIABLE GEOMETRY TURBOCHARGER AND AN INTAKE THROTTLE VALVE TO FACILITATE A REGENERATION PROCESS

TECHNICAL FIELD

The present disclosure relates generally to controlling an intake manifold absolute pressure (IMAP) of an engine and, for example, to using a variable geometry turbocharger (VGT) and an intake throttle valve (ITV) to control the IMAP of the engine.

BACKGROUND

Internal combustion engines, such as diesel engines, produce exhaust gas that contains a variety of pollutants. These pollutants may include, for example, particulate matter (e.g., soot), nitrogen oxides ($NO_x$), and/or sulfur compounds. In some cases, an engine may include a particulate collection device and/or an exhaust aftertreatment device to remove and/or convert particulate matter and/or the other pollutants in the exhaust gas. The particulate collection device and/or the exhaust aftertreatment device may use heat from the exhaust gas, in conjunction with an oxidation catalyst (e.g., a diesel oxidation catalyst (DOC)), to facilitate removing and/or converting the particulate matter and/or other pollutants. However, under certain operating conditions (e.g., when the engine is idling, when environmental temperatures are low, and/or the like), an exhaust gas temperature may fall below a minimum operating temperature for the particulate collection device, the aftertreatment device, and/or the like to operate in an efficient and/or effective manner.

U.S. Pat. No. 8,752,364 (the '364 patent) discloses producing an elevated exhaust temperature and reduced $NO_x$ output for an engine. The '364 patent discloses a technique that includes an operation to determine and implement a VGT strategy that includes an operation to adjust a VGT for controlling engine exhaust gas temperatures. Per the '364 patent, the technique can include, when there is a determination that an actual filter inlet exhaust gas temperature does not achieve a desired filter exhaust gas temperature, an operation to determine and implement an intake throttle strategy and command until the desired filter exhaust gas temperature is met.

While the '364 patent is directed to providing a technique for controlling engine exhaust gas temperatures using a VGT and an intake throttle, the '364 patent only discloses controlling the intake throttle based on a filter inlet exhaust gas temperature. Furthermore, the '364 patent discloses that the intake throttle can be used to further increase an exhaust gas temperature after the VGT has been adjusted, but does not disclose determining when, or under what conditions, the intake throttle could be independently controlled, as opposed to in conjunction with the VGT, to increase the exhaust gas temperature.

Accordingly, the controller of the present disclosure solves one or more of the problems set forth above and/or other problems in the art.

SUMMARY

In some implementations, a method includes determining, by a controller, that a regeneration process associated with an engine of a machine is active; obtaining, by the controller and based on determining that the regeneration process is active, information concerning a speed of the engine, information concerning a load of the engine, and information concerning a fuel rate of the engine; selecting, by the controller and based on the information concerning the speed of the engine, the information concerning the load of the engine, and the information concerning the fuel rate of the engine, a control process, of a plurality of control processes, to control an IMAP of the engine to facilitate the regeneration process; and causing, by the controller and according to the selected control process, adjustment of one or more components of a VGT of the engine and an ITV of the engine.

In some implementations, a device includes one or more memories; and one or more processors, communicatively coupled to the one or more memories, configured to: obtain information concerning a speed of an engine of a machine, a load of the engine, and a fuel rate of the engine; select, based on the information, a control process, of a plurality of control processes, to control an IMAP of the engine to facilitate a regeneration process associated with the engine; and cause, according to the selected control process, adjustment of at least one component of a VGT of the engine and an ITV of the engine.

In some implementations, a non-transitory computer-readable medium storing a set of instructions includes one or more instructions that, when executed by one or more processors of a device, cause the device to: obtain information concerning a speed of an engine of a machine and information concerning a fuel rate of the engine; select, based on the information concerning the speed of the engine and the information concerning the fuel rate of the engine, a control process, of a plurality of control processes, to control an IMAP of the engine to facilitate a regeneration process associated with the engine; and control, according to the selected control process, adjustment of one or more components of a VGT of the engine and an ITV of the engine.

DETAILED DESCRIPTION

This disclosure relates to a controller, such as an engine control module (ECM), controlling a VGT of an engine and/or an ITV to control an IMAP of the engine and thereby control an exhaust gas temperature (e.g., of an exhaust gas produced by the engine) to facilitate a regeneration process. The controller, VGT, and/or ITV, as described herein, have universal applicability to any machine utilizing such a controller, VGT, and/or throttle valve. The term "machine" may refer to any machine that performs an operation associated with an industry such as, for example, mining, construction, farming, transportation, or any other industry. As some examples, the machine may be a vehicle, an off-highway truck, a backhoe loader, a cold planer, a wheel loader, a compactor, a feller buncher, a forest machine, a forwarder, a harvester, an excavator, an industrial loader, a knuckleboom loader, a material handler, a motor grader, a pipelayer, a road reclaimer, a skid steer loader, a skidder, a telehandler, a tractor, a dozer, a tractor scraper, or other above ground equipment, underground equipment, aerial equipment, or marine equipment.

Figure 1:
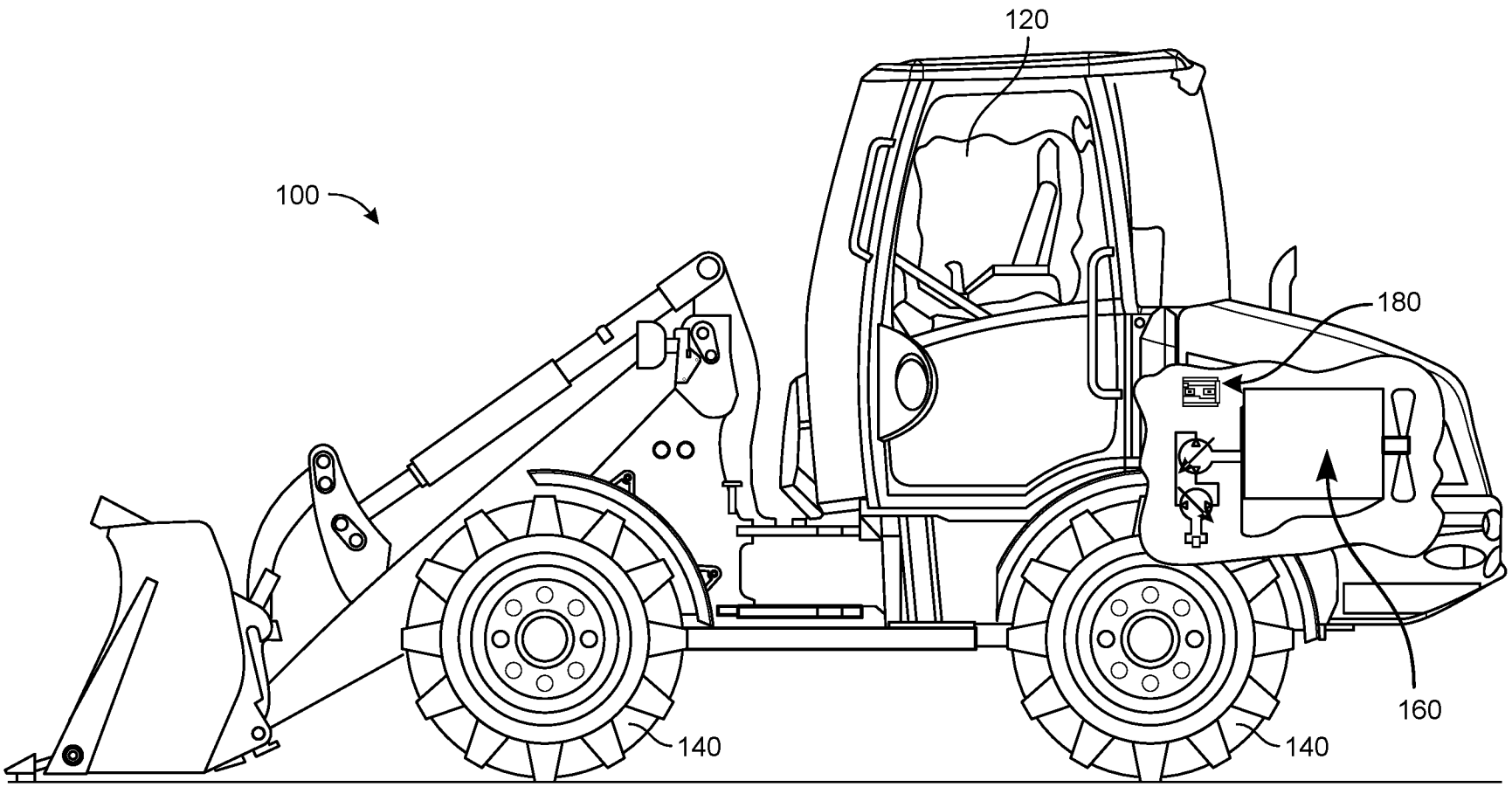
FIG. 1 is diagram of an example machine described herein.

FIG. 1 is a diagram of an example machine 100 described herein. For example, machine 100 may include a mobile machine, such as the wheel loader shown in FIG. 1, or any other type of mobile machine. Machine 100 may include an operator station 120, one or more traction devices 140 (sometimes referred to as ground engagements), an engine 160 operatively connected to provide power to drive at least one of traction devices 140, and a controller 180 (e.g., an ECM) connected to one or more components of machine 100. The controller 180 may perform operations related to controlling a VGT and/or ITV of the engine 160 to control an IMAP of the engine 160 and/or an exhaust gas temperature of an exhaust gas produced by the engine 160, as described in more detail elsewhere herein.

As indicated above, FIG. 1 is provided as an example. Other examples may differ from what is described in connection with FIG. 1.

Figure 2:
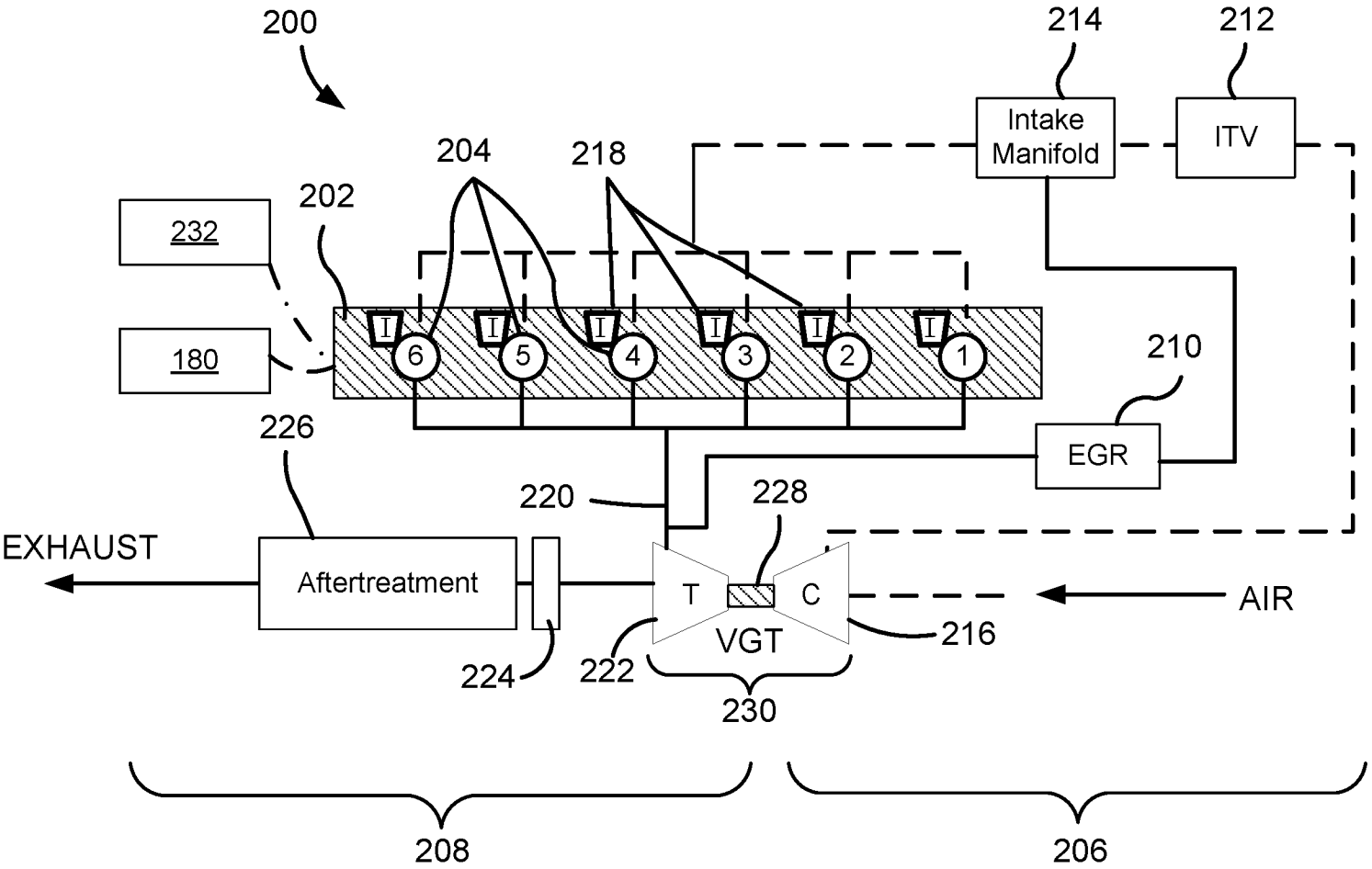
FIG. 2 is a diagram of an example engine system described herein.

FIG. 2 is a diagram of an example engine system 200 described herein. The engine system 200 may include a compression ignition, internal combustion engine, such as engine 160, but may include any other type of internal combustion engine. The engine system 200 may be fueled by such fuels as distillate diesel fuel, biodiesel, dimethyl ether, gaseous fuels, such as hydrogen, natural gas, and propane, alcohol, ethanol, and/or any combination thereof. Engine system 200 may include an engine block 202 (e.g., of the engine of engine system 200) with a plurality of cylinders 204 (engine block 202 of FIG. 2 is shown with six cylinders 204, labeled 1-6).

Engine system 200 may include multiple systems. For example, as shown in the example of FIG. 2, engine system 200 may include an air intake or air induction system 206, an exhaust system 208, and/or an exhaust gas recirculation (EGR) system 210. Air induction system 206 may be configured to direct air, or an air and fuel mixture (e.g., of air and another gas, such as exhaust gas) into engine system 200 for subsequent combustion. Exhaust system 208 may exhaust or release byproducts of the combustion to an atmosphere external to engine system 200. A recirculation loop of the EGR system 210 may be configured to direct a portion of the exhaust gases from exhaust system 208 back into air induction system 206 for subsequent combustion.

Air induction system 206 may include multiple components that cooperate to condition and introduce compressed air into cylinders 204. For example, air induction system 206 may include an ITV 212 and/or an intake manifold 214 located downstream of one or more compressors 216. The ITV 212 may selectively regulate (e.g., restrict) a flow of air into intake manifold 214. Intake manifold 214 may mix air and exhaust gas to create an air and exhaust gas mixture that is directed to the plurality of cylinders 204. The air induction system 206 feeds variable valve actuators 218 associated with respective ones of cylinders 204.

Exhaust system 208 may include multiple components that cooperate to condition and direct exhaust gas from cylinders 204 to the atmosphere. For example, exhaust system 208 may include an exhaust passageway 220, one or more turbines 222 driven by exhaust gas flowing through exhaust passageway 220, a particulate collection device 224, such as a diesel particulate filter (DPF) located downstream of turbine 222, and/or an exhaust aftertreatment device 226 (e.g., an aftertreatment selective catalytic reduction (SCR) device) fluidly connected downstream of particulate collection device 224.

Turbine 222 may be located to receive exhaust gas leaving engine system 200 and may be connected to the one or more compressors 216 of air induction system 206 by way of a common shaft 228. As exhaust gas exiting engine system 200 flows through turbine 222 and expands against vanes thereof, turbine 222 may rotate and drive the one or more compressors 216 to pressurize inlet air.

The one or more compressors 216, common shaft 228, and turbine 222 may form a turbocharger, such as a variable geometry turbocharger (VGT) 230. Turbine 222 (hereinafter referred to as "VGT turbine 222") may include adjustable vanes such that a distance between the adjustable vanes may be changed to alter a performance of the VGT 230. For example, the adjustable vanes of VGT turbine 222 may be extended to a "closed" position or may be retracted to an "open" position, which may cause more or less air and/or exhaust gas from exhaust system 208 to enter into air induction system 206.

Particulate collection device 224 may be a DPF located downstream of VGT turbine 222 to remove particulate matter from the exhaust gas of engine system 200. Collected particulates may be removed through a regeneration process, which requires the temperature of the exhaust gas entering particulate collection device 224 to be high enough (e.g., greater than 150° C., 200° C., 250° C., and/or the like), in combination with a catalyst, to burn away trapped particulates. As part of the regeneration process, heat from the exhaust gas is applied to the trapped particulates to elevate the temperature thereof to an ignition threshold.

Exhaust aftertreatment device 226 may receive exhaust gas from VGT turbine 222 and trap or convert particular constituents (e.g., NOR) in the exhaust gas stream. Similar to the particulate collection device 224, the temperature of the exhaust gas flow entering exhaust aftertreatment device 226 needs to be high enough, in combination with an oxidation catalyst and a reductant, to react with NOR in the exhaust gas to form water ($H_2O$) and elemental nitrogen ($N_2$).

Engine system 200 of FIG. 2 includes controller 180. Controller 180, as described herein, provides control of engine system 200 and/or components of engine system 200. Controller 180 may be implemented as a processor, such as a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. The processor may be implemented in hardware, firmware, and/or a combination of hardware and software. Controller 180 may include one or more processors capable of being programmed to perform a function. One or more memories, including a random-access memory (RAM), a read only memory (ROM), and/or another type of dynamic or static storage device (e.g., a flash memory, a magnetic memory, and/or an optical memory) may store information and/or instructions for use by controller 180. Controller 180 may include a memory (e.g., a non-transitory computer-readable medium) capable of storing instructions, that when executed, cause the processor to perform one or more processes and/or methods described herein.

Sensor system 232 may provide measurements associated with various parameters used by controller 180 to control engine system 200 and/or components of engine system 200. Sensor system 232 may include physical sensors and/or any appropriate type of control system that generates values of sensing parameters based on a computational model and/or one or more measured parameters. As used herein, sensing parameters may refer to those measurement parameters that are directly measured and/or estimated by one or more sensors (e.g., physical sensors, virtual sensors, and/or the like). Example sensors may include temperature sensors (e.g., to measure a temperature of exhaust gas at VGT turbine 222, particulate collection device 224, exhaust aftertreatment device 226, and/or the like), speed sensors (e.g., to measure a speed of the engine of engine system 200, such as in terms of revolutions per minute (RPM), and/or a speed of machine 100, such as in terms of kilometers per hour, miles per hour), fuel rate sensors (e.g., to measure a fuel rate corresponding to a quantity of fuel (a fuel flow) provided to the plurality of cylinders 204, such as in terms of a volume (in cubic millimeters) of fuel injected by an injector into a cylinder 204), chemical composition sensors (e.g., to measure an amount of $NO_x$ in exhaust gas), pressure sensors (e.g., to measure an IMAP associated with the intake manifold 214 and/or the engine system 200, such as in terms of kilopascals (kPa)), engine airflow sensors (e.g., to measure an engine airflow rate, such as in terms of cubic meters per minute, cubic feet per minute, and/or the like), engine braking sensors (e.g., to measure a requested amount of engine braking power) and/or the like. Sensing parameters may also include any output parameters that may be measured indirectly by physical sensors and/or calculated based on readings of physical sensors.

As indicated above, FIG. 2 is provided as an example. Other examples may differ from what is described in connection with FIG. 2.

Figure 3:
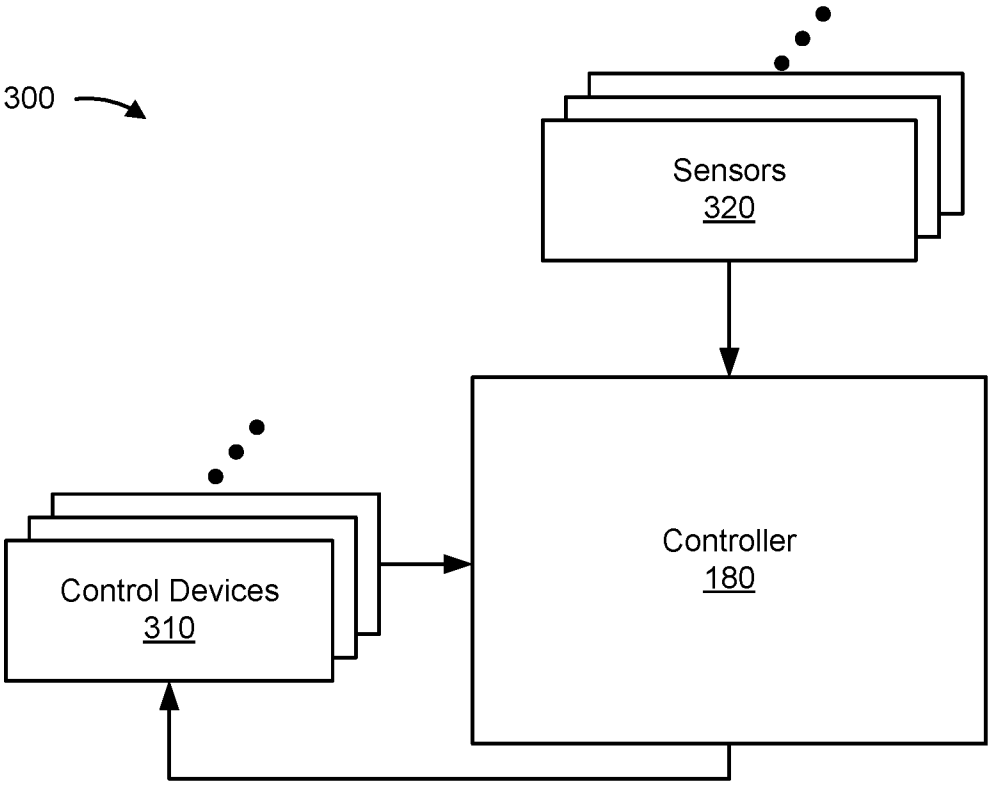
FIG. 3 is a diagram of an example environment in which systems and/or methods described herein may be implemented.

FIG. 3 is a diagram of an example environment 300 in which systems and/or methods described herein may be implemented. As shown in FIG. 3, environment 300 may include one or more control devices 310 (referred to individually as "control device 310" and collectively as "control devices 310") and one or more sensors 320 (referred to individually as "sensor 320" and collectively as "sensors 320") and controller 180. Devices and/or components of environment 300 may interconnect via wired connections, wireless connections, or a combination of wired and wireless connections.

Control device 310 may be any type of device that may be used by controller 180 to control a performance feature of engine system 200. For example, control device 310 may include one or more actuators, switches, and/or the like that are capable of controlling a component of engine system 200. Control device 310 may be capable of causing adjustment of one or more components of VGT 230, such as adjustable vanes of VGT turbine 222 (e.g., from a first vane position to a second vane position), and/or causing adjustment of ITV 212 (e.g., from a first ITV position to a second ITV position), among other examples. Sensors 320 may include any type of sensor configured to measure operating conditions of engine system 200. Sensors 320 may be sensors of sensor system 234, as described herein.

Controller 180 may include one or more devices configured to control one or more components of engine system 200. For example, controller 180 may be configured to control VGT 230 and/or ITV 212 to control an IMAP of the engine system 200 and/or an exhaust gas temperature of engine system 200. Controller 180 may control the one or more components of engine system 200 by sending one or more commands to control device 310.

Controller 180 may obtain information concerning engine system 200 from sensors 320 (e.g., directly from sensors 320 or via one or more other components or devices of engine system 200, such as a different controller). For example, controller 180 may obtain information indicating a status of a regeneration process associated with an engine of the engine system 200 (e.g., whether heat from exhaust gas of engine system 200 is being used to facilitate treatment of the exhaust gas by particulate collection device 224 and/or exhaust aftertreatment device 226). As another example, controller 180 may obtain information concerning a speed of the engine, information concerning a load of the engine, and/or information concerning a fuel rate of the engine. In another example, controller 180 may obtain information concerning an exhaust gas (e.g., a temperature of the exhaust gas at VGT turbine 222, particulate collection device 224 and/or exhaust aftertreatment device 226), information concerning the IMAP of the engine, information concerning a braking procedure associated with the engine (e.g., information indicating whether engine braking and/or external braking is active to reduce the speed of machine 100), and/or information concerning an acceleration procedure associated with the engine (e.g., information indicating whether the engine is engaged in accelerating the machine 100), among other examples. Additionally, or alternatively, controller 180 may obtain information concerning a position of ITV 212, information concerning a position of adjustable vanes of VGT 230, information concerning a speed of VGT 230, and/or information concerning a speed of the machine 100, among other examples.

Controller 180 may process the information concerning engine system 200 to determine one or more parameters. For example, controller 180 may process (e.g., parse) the information indicating the status of the regeneration process to determine whether the regeneration process is active. As another example, controller 180 (e.g., after determining that the regeneration process is active) may process the information concerning the speed of the engine to determine the speed of the engine, the information concerning the load of the engine to determine the load of the engine, the information concerning the fuel rate of the engine to determine the fuel rate of the engine, and so on. In this way, controller 180 may process the information concerning engine system 200 to further determine the exhaust gas temperature, the IMAP of the engine, whether a braking procedure is active, whether an acceleration procedure is active, the position of ITV 212, the position of adjustable vanes of VGT 230, the speed of VGT 230, and/or the speed of the machine 100, among other examples.

Controller 180 may evaluate the one or more parameters to select a control process to control one or more components of engine system 200 to control the IMAP of the engine of the engine system 200 (and thereby control the exhaust gas temperature to facilitate the regeneration process). In some implementations, controller 180 may select a control process, from a plurality of control processes, based on the speed of the engine, the load of the engine, and/or the fuel rate of the engine. For example, controller 180 may select an ITV-focused control process or a VGT-focused control process, as further described herein.

In a first example, controller 180 may determine whether the speed of the engine is within a particular engine speed range (e.g., the speed of the engine is greater than or equal to a minimum engine speed threshold and less than or equal to a maximum engine speed threshold), whether the load of the engine is within a particular engine load range (e.g., the load of the engine is greater than or equal to a minimum engine load threshold and less than or equal to a maximum engine load threshold), and/or the fuel rate of the engine is within a particular engine fuel rate range (e.g., the fuel rate of the engine is greater than or equal to a minimum engine fuel rate threshold and less than or equal to a maximum engine fuel rate threshold), among other examples. Controller 180 may select a particular control process, such as the ITV-focused control process (e.g., as described in detail below), from the plurality of control processes, when controller 180 determines that the speed of the engine is within the particular engine speed range, the load of the engine is within the particular engine load range, and/or the fuel rate of the engine is within the particular engine fuel rate range. Alternatively, controller 180 may select a different control process, such as the VGT-focused control process (e.g., as described in detail below), from the plurality of control processes, when controller 180 determines that at least one of the speed of the engine, the load of the engine, or the fuel rate is respectively outside the particular engine speed range, the particular engine load range, and/or the particular engine fuel rate range.

In an additional example, after controller 180 determines that the speed of the engine is within the particular engine speed range, the load of the engine is within the particular engine load range, and/or the fuel rate of the engine is greater than the maximum engine fuel rate threshold, controller 180 may obtain the information concerning the exhaust gas temperature of the engine (e.g., as described above) and determine whether the exhaust gas temperature satisfies (e.g., is greater than) an exhaust gas temperature threshold (e.g., a minimum operating temperature for particulate collection device 224 and/or exhaust aftertreatment device 226 to operate in an efficient and/or effective manner to remove and/or convert particulate matter and/or other emissions in the exhaust gas as part of the regeneration process). Controller 180 may select a particular control process, such as the VGT-focused control process (e.g., as described in detail below), from the plurality of control processes, when controller 180 determines that the exhaust gas temperature satisfies the exhaust gas temperature threshold and, alternatively, may select a different process, such as the ITV-focused control process (e.g., as described in detail below), from the plurality of control processes, when controller 180 determines that the exhaust gas temperature fails to satisfy the exhaust gas temperature threshold.

In another example, after controller 180 determines that the speed of the engine is within the particular engine speed range, the load of the engine is within the particular engine load range, and/or the fuel rate of the engine is greater than the maximum engine fuel rate threshold, controller 180 may obtain the information concerning the braking procedure (e.g., as described above) and determine whether the braking procedure is active. Controller 180 may select a particular control process, such as the VGT-focused control process (e.g., as described in detail below), from the plurality of control processes, when controller 180 determines that the braking procedure is active and, alternatively, may select a different process, such as the ITV-focused control process (e.g., as described in detail below), from the plurality of control processes, when controller 180 determines that the braking procedure is not active.

As an additional example, after controller 180 determines that the speed of the engine is within the particular engine speed range, the load of the engine is within the particular engine load range, and/or the fuel rate of the engine is greater than the maximum engine fuel rate threshold, controller 180 may obtain the information concerning the acceleration procedure (e.g., as described above) and determine whether the acceleration procedure is active. Controller 180 may select a particular control process, such as the VGT-focused control process (e.g., as described in detail below), from the plurality of control processes, when controller 180 determines that the acceleration procedure is active and, alternatively, may select a different process, such as the ITV-focused control process (e.g., as described in detail below), from the plurality of control processes, when controller 180 determines that the acceleration procedure is not active.

After selecting a control process, controller 180 may control one or more components of engine system 200 according to the selected control process. In this way, controller 180 may control IMAP of the engine and thereby control the exhaust gas temperature to facilitate the regeneration process. For example, controller 180 may cause adjustment of the one or more components of the VGT 230 and/or ITV 212 according to the selected control process.

In some implementations, when the selected control process is the VGT-focused control process, controller 180 may, according to the VGT-focused control process, "lock" ITV 212 and cause adjustment of the one or more components of the VGT 230 to cause the IMAP of the engine to match a target IMAP (e.g., a desired IMAP or an optimal IMAP correlated with providing a sufficiently high exhaust gas temperature to facilitate the regeneration process). For example, controller 180 may cause ITV 212 to adjust to a particular ITV position (e.g., a "closed" ITV position, a first "open" ITV position, a second "open" ITV position, and/or a third "open" ITV position, among other examples) for a period of time (e.g., thousandths of a second, hundredths of a second, tenths of a second, and/or seconds, among other examples). In this way, controller 180 "locks" ITV 212 at the particular ITV position (e.g., causes ITV 212 to stay at the particular ITV position) for the duration of the period of time. Accordingly, controller 180 may cause the one or more components of the VGT 230 to adjust to one or more respective VGT positions during the period of time (e.g., while ITV 212 is "locked" at the particular ITV position). For example, controller 180 may cause the adjustable vanes of VGT 230 (e.g., of VGT turbine 222) to adjust from a first vane position, to a second vane position, to a third vane position, and so on (e.g., adjust to a "closed" vane position, adjust to a first "open" vane position, and/or adjust to a second "open" vane position, among other examples) during the period of time. In this way, controller 180 may cause the VGT to increase or decrease a flow of air in air induction system 206 during the period of time, which may cause the IMAP of the engine to match the target IMAP (e.g., within a tolerance) and therefore cause the exhaust gas temperature to be sufficiently high to facilitate the regeneration process.

In some implementations, when the selected control process is the ITV-focused control process, controller 180, according to the ITV-focused control process, may "lock" the VGT 230 and cause adjustment of ITV 212 to cause the IMAP of the engine to match the target IMAP (e.g., the desired IMAP or the optimal IMAP correlated with providing a sufficiently high exhaust gas temperature to facilitate the regeneration process). For example, controller 180 may cause the one or more components of the VGT 230 to adjust to one or more respective particular VGT positions for a period of time (e.g., thousandths of a second, hundredths of a second, tenths of a second, and/or seconds, among other examples). In this way, controller 180 "locks" the one or more components of the VGT 230 at the one or more respective particular VGT positions (e.g., causes the one or more components of the VGT 230 to stay at the one or more respective particular VGT positions) for the period of time.

Accordingly, controller 180 may cause ITV 212 to adjust to one or more ITV positions during the period of time (e.g., while the one or more components of the VGT 230 are "locked" at the one or more respective particular VGT positions). For example, controller 180 may cause ITV 212 to adjust from a first ITV position, to a second ITV position, to a third ITV position, and so on (e.g., adjust to a "closed" ITV position, adjust to a first "open" ITV position, and/or adjust to a second "open" ITV position, among other examples) during the period of time. In this way, controller 180 may cause ITV 212 to increase or decrease a flow of air in air induction system 206 during the period of time, which may cause the IMAP of the engine to match the target IMAP (e.g., within a tolerance) and therefore cause the exhaust gas temperature to be sufficiently high to facilitate the regeneration process.

In some implementations, controller 180, to determine the target IMAP (e.g., as part of the VGT-focused control process and/or the ITV-focused control process), may obtain the information concerning the exhaust gas temperature of the engine (e.g., that indicates a current temperature of the exhaust gas) and the information concerning the IMAP of the engine (e.g., that indicates a current IMAP of the engine) as described herein. Controller 180 may thereby determine the target IMAP of the engine by searching a data structure (e.g., a data structure associated with a table, a model, a chart, a graph, and/or a plot, among other examples, that indicates at least one relationship between exhaust gas temperatures and IMAPs of the engine) based on the information concerning the exhaust gas temperature and the information concerning the IMAP.

While some implementations described herein concern controller 180 causing the adjustable vanes of VGT 230 to adjust (e.g., from a first vane position to a second vane position), implementations also include controller 180 causing one or more additional components of VGT 230 to adjust. For example, controller 180 may cause an adjustable intake or an adjustable outlet of VGT turbine 222 to adjust. As another example, controller 180 may cause an adjustable flow area control element of VGT 230 to adjust. Accordingly, controller 180 may cause the one or more additional components of VGT 230 to adjust when causing (or instead of causing) the adjustable vanes of VGT 230 to adjust.

The number and arrangement of devices and networks shown in FIG. 3 are provided as an example. In practice, there may be additional devices, fewer devices, different devices, or differently arranged devices than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of environment 300 may perform one or more functions described as being performed by another set of devices of environment 300.

Figure 4:
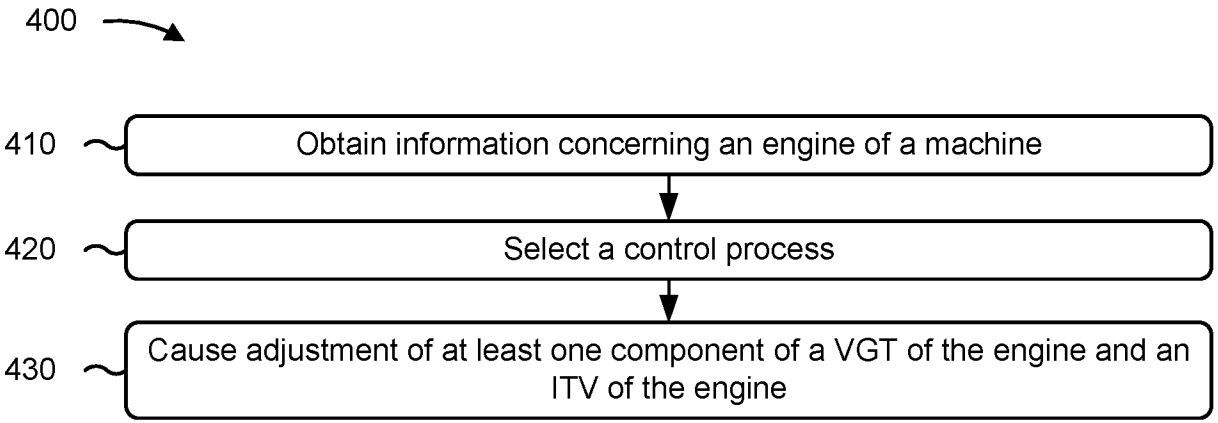
FIG. 4 is a flowchart of an example process for controlling an IMAP of an engine using a VGT and an ITV to facilitate a regeneration process.

FIG. 4 is a flowchart of an example process 400 for controlling an IMAP of an engine using a VGT and an ITV to facilitate a regeneration process. One or more process blocks of FIG. 4 may be performed by a controller (e.g., controller 180). One or more process blocks of FIG. 4 may be performed by another device or a group of devices separate from or including the ECM, such as a control device (e.g., control device 310), a sensor (e.g., sensor 320), and/or the like.

As shown in FIG. 4, process 400 may include obtaining information concerning an engine of a machine (block 410). For example, the controller may obtain information concerning a speed of an engine of a machine, a load of the engine, and a fuel rate of the engine, as described above.

As further shown in FIG. 4, process 400 may include selecting a control process (block 420). For example, the controller may select, based on the information, a control process (e.g., a VGT-focused control process or an ITV-focused control process) from a plurality of control processes, as described above. The controller may use the selected control process to control an IMAP of the engine to facilitate a regeneration process associated with the engine.

As further shown in FIG. 4, process 400 may include causing adjustment of at least one component of a VGT of the engine and an ITV of the engine (block 430). For example, the controller may cause, according to the selected control process, adjustment of at least one component of a VGT of the engine and an ITV of the engine, as described above.

Process 400 may include additional implementations, such as any single implementation or any combination of implementations described in connection with one or more other processes described elsewhere herein.

Although FIG. 4 shows example blocks of process 400, process 400 may include additional blocks, fewer blocks, different blocks, or differently arranged blocks than those depicted in FIG. 4. Additionally, or alternatively, two or more of the blocks of process 400 may be performed in parallel.

INDUSTRIAL APPLICABILITY

The above-described techniques allow a controller 180 of an engine (e.g., associated with engine system 200) of a machine 100 to control a VGT 230 (e.g., comprising one or more compressors 216, common shaft 228, and VGT turbine 222) and/or an ITV 212 of the engine according to a selected control process. In this way, the controller 180 may lock VGT 230 and cause adjustment of ITV 212 (or vice versa) to manage an IMAP of the engine. This may allow controller 180 to thereby manage an exhaust gas temperature to allow a particulate collection device and/or an aftertreatment device of the engine to remove and/or convert particulate matter and/or other emissions in an exhaust gas of the engine. This may be particularly beneficial in situations when the engine cannot generate sufficiently hot exhaust gas, such as in low ambient temperatures, when the engine is idle, and/or during engine braking procedures when fuel is not injected into engine cylinders, among other examples. Moreover, controlling VGT 230 and ITV 212 in this way allows controller 180 to maintain a performance of the engine (e.g., without degrading a performance of the machine 100) that would not otherwise be possible by adjusting only VGT 230 or only ITV 212 to control the IMAP of the engine.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

Some implementations are described herein in connection with thresholds. As used herein, satisfying a threshold may, depending on the context, refer to a value being greater than the threshold, more than the threshold, higher than the threshold, greater than or equal to the threshold, less than the threshold, fewer than the threshold, lower than the threshold, less than or equal to the threshold, equal to the threshold, etc., depending on the context.

What is claimed is:

1. A method, comprising:

determining, by a controller, that a regeneration process associated with an engine of a machine is active;

obtaining, by the controller and based on determining that the regeneration process is active, information concerning a speed of the engine, information concerning a load of the engine, and information concerning a fuel rate of the engine;

selecting, by the controller and based on the information concerning the speed of the engine, the information concerning the load of the engine, and the information concerning the fuel rate of the engine, a control process, of a plurality of control processes, to control an intake manifold absolute pressure (IMAP) of the engine to facilitate the regeneration process; and causing, by the controller and according to the selected control process, adjustment of one or more components of a variable geometry turbocharger (VGT) of the engine and an intake throttle valve (ITV) of the engine.

2. The method of claim 1, wherein the plurality of control processes include a VGT-focused control process and an ITV-focused control process.

3. The method of claim 1, wherein the selected control process is a VGT-focused control process, wherein causing adjustment of the one or more components of the VGT and the ITV comprises:

causing, according to the VGT-focused control process, the ITV to adjust to a particular ITV position for a period of time; and causing, according to the VGT-focused control process, the one or more components of the VGT to adjust to one or more VGT positions during the period of time to cause the IMAP to match a particular IMAP.

4. The method of claim 1, wherein the selected control process is an ITV-focused control process, wherein causing adjustment of the one or more components of the VGT and the ITV comprises:

causing, according to the ITV-focused control process, the one or more components of the VGT to adjust to particular VGT positions for a period of time; and causing, according to the ITV-focused control process, the ITV to adjust to one or more ITV positions during the period of time to cause the IMAP to match a particular IMAP.

5. The method of claim 1, wherein selecting the control process comprises:

determining, based on the information concerning the speed of the engine, that the speed of the engine is within a particular engine speed range;

determining, based on the information concerning the load of the engine, that the load of the engine is within a particular engine load range;

determining, based on the information concerning the fuel rate of the engine, that the fuel rate of the engine is within a particular fuel rate range; and selecting an ITV-focused control process, from the plurality of control processes, based on determining that the speed of the engine is within the particular engine speed range, that the load of the engine is within the particular engine load range, and that the fuel rate of the engine is within the particular fuel rate range.

6. The method of claim 1, wherein selecting the control process comprises:

determining, based on the information concerning the speed of the engine, that the speed of the engine is within a particular engine speed range;

determining, based on the information concerning the load of the engine, that the load of the engine is within a particular engine load range;

determining, based on the information concerning the fuel rate of the engine, that the fuel rate of the engine is greater than a maximum fuel rate threshold;

obtaining information concerning an exhaust gas temperature of the engine based on determining that the speed of the engine is within the particular engine speed range, that the load of the engine is within the particular engine load range, and that the fuel rate of the engine is greater than the maximum fuel rate threshold;

determining that the exhaust gas temperature of the engine is greater than or equal to a particular exhaust gas temperature associated with the regeneration process; and selecting a VGT-focused control process, from the plurality of control processes, based on determining that the exhaust gas temperature of the engine is greater than the particular exhaust gas temperature.

7. The method of claim 1, wherein selecting the control process comprises:

determining, based on the information concerning the speed of the engine, that the speed of the engine is within a particular engine speed range;

determining, based on the information concerning the load of the engine, that the load of the engine is within a particular engine load range;

determining, based on the information concerning the fuel rate of the engine, that the fuel rate of the engine is greater than a maximum fuel rate threshold;

obtaining information concerning an exhaust gas temperature of the engine based on determining that the speed of the engine is within the particular engine speed range, that the load of the engine is within the particular engine load range, and that the fuel rate of the engine is greater than the maximum fuel rate threshold;

determining that the exhaust gas temperature of the engine is less than a particular exhaust gas temperature associated with the regeneration process; and selecting an ITV-focused control process, from the plurality of control processes, based on determining that the exhaust gas temperature of the engine is less than the particular exhaust gas temperature.

8. The method of claim 1, wherein selecting the control process comprises:

determining, based on the information concerning the speed of the engine, that the speed of the engine is within a particular engine speed range;

determining, based on the information concerning the load of the engine, that the load of the engine is within a particular engine load range;

determining, based on the information concerning the fuel rate of the engine, that the fuel rate of the engine is within a particular fuel rate range;

obtaining information concerning a braking procedure associated with the engine based on determining that the speed of the engine is within the particular engine speed range, that the load of the engine is within the particular engine load range, and that the fuel rate of the engine is within the particular fuel rate range;

determining that the braking procedure is active based on the information concerning the braking procedure; and selecting a VGT-focused control process, from the plurality of control processes, based on determining that the braking procedure is active.

9. The method of claim 1, wherein selecting the control process comprises:

determining, based on the information concerning the speed of the engine, that the speed of the engine is within a particular engine speed range;

determining, based on the information concerning the load of the engine, that the load of the engine is within a particular engine load range;

determining, based on the information concerning the fuel rate of the engine, that the fuel rate of the engine is within a particular fuel rate range;

obtaining information concerning an acceleration procedure associated with the engine based on determining that the speed of the engine is within the particular engine speed range, that the load of the engine is within the particular engine load range, and that the fuel rate of the engine is within the particular fuel rate range;

determining that the acceleration procedure is active based on the information concerning the acceleration procedure; and selecting a VGT-focused control process, from the plurality of control processes, based on determining that the acceleration procedure is active.

10. A device, comprising:

one or more memories; and one or more processors, communicatively coupled to the one or more memories, configured to:

obtain information concerning a speed of an engine of a machine, a load of the engine, and a fuel rate of the engine;

select, based on the information, a control process, of a plurality of control processes, to control an intake manifold absolute pressure (IMAP) of the engine to facilitate a regeneration process associated with the engine; and cause, according to the selected control process, adjustment of at least one component of a variable geometry turbocharger (VGT) of the engine and an intake throttle valve (ITV) of the engine.

11. The device of claim 10, wherein the selected control process is a VGT-focused control process, wherein the one or more processors, when causing adjustment of the one or more components of the VGT and the ITV, are configured to:

obtain, according to the VGT-focused control process, additional information concerning an exhaust gas temperature of the engine and the IMAP;

determine, based on the information and the additional information, a particular IMAP;

cause, according to the VGT-focused control process, the ITV to adjust to a particular ITV position for a period of time; and cause, according to the VGT-focused control process, the at least one component of the VGT to adjust to one or more VGT positions during the period of time to cause the IMAP to match the particular IMAP.

12. The device of claim 10, wherein the selected control process is an ITV-focused control process, wherein the one or more processors, when causing adjustment of the one or more components of the VGT and the ITV, are configured to:

obtain, according to the ITV-focused control process, additional information concerning an exhaust gas temperature of the engine and the IMAP;

determine, based on the additional information, a particular IMAP;

cause, according to the ITV-focused control process, the at least one component of the VGT to adjust to at least one particular VGT position for a period of time; and cause, according to the ITV-focused control process, the ITV to adjust to one or more ITV positions during the period of time to cause the IMAP to match the particular IMAP.

13. The device of claim 10, wherein the one or more processors, when selecting the control process are configured to:

determine, based on the information, the speed of the engine, the load of the engine, and the fuel rate of the engine;

select an ITV-focused control process, from the plurality of control processes, based on the speed of the engine being within a particular engine speed range, the load of the engine being within a particular engine load range, and the fuel rate of the engine being within a particular engine fuel rate range.

14. The device of claim 10, wherein the one or more processors, when selecting the control process are configured to:

determine, based on the information, the speed of the engine, the load of the engine, and the fuel rate of the engine, determine that at least one of the speed of the engine, the load of the engine, or the fuel rate of the engine is outside of a respective desired range; and select a VGT-focused control process, from the plurality of control processes, based on determining that the at least one of the speed of the engine, the load of the engine, or the fuel rate of the engine is outside of a respective desired range.

15. A non-transitory computer-readable medium storing a set of instructions, the set of instructions comprising:

one or more instructions that, when executed by one or more processors of a device, cause the device to:

obtain information concerning a speed of an engine of a machine and information concerning a fuel rate of the engine;

select, based on the information concerning the speed of the engine and the information concerning the fuel rate of the engine, a control process, of a plurality of control processes, to control an intake manifold absolute pressure (IMAP) of the engine to facilitate a regeneration process associated with the engine; and control, according to the selected control process, adjustment of one or more components of a variable geometry turbocharger (VGT) of the engine and an intake throttle valve (ITV) of the engine.

16. The non-transitory computer-readable medium of claim 15, wherein the one or more instructions, that cause the device to control adjustment of the one or more components of the VGT and the ITV, cause the device to:

cause, according to the selected control process, the ITV to stay at a particular ITV position for a period of time; and cause, according to the selected control process, the one or more components of the VGT to adjust to one or more VGT positions during the period of time.

17. The non-transitory computer-readable medium of claim 15, wherein the one or more instructions, that cause the device to control adjustment of the one or more components of the VGT and the ITV, cause the device to:

cause, according to the selected control process, the one or more components of the VGT to stay at one or more respective VGT positions for a period of time; and cause, according to the selected control process, the ITV to adjust to one or more ITV positions during the period of time.

18. The non-transitory computer-readable medium of claim 15, wherein the one or more instructions, that cause the device to select the control process, of the plurality of control processes, cause the device to:

determine, based on the information concerning the speed of the engine, that the speed of the engine is within a particular engine speed range;

determine, based on the information concerning the fuel rate of the engine, that the fuel rate of the engine is within a particular fuel rate range; and select a particular control process, from the plurality of control processes, based on determining that the speed of the engine is within the particular engine speed range and that the fuel rate of the engine is within the particular fuel rate range.

19. The non-transitory computer-readable medium of claim 15, wherein the one or more instructions, that cause the device to select the control process, of the plurality of control processes, cause the device to:

determine, based on the information concerning the speed of the engine, that the speed of the engine is within a particular engine speed range;

determine, based on the information concerning the fuel rate of the engine, that the fuel rate of the engine is greater than a maximum fuel rate threshold;

obtain information concerning an exhaust gas temperature of the engine based on determining that the speed of the engine is within the particular engine speed range and that the fuel rate of the engine is greater than the maximum fuel rate threshold;

determine that the exhaust gas temperature of the engine is greater than a particular exhaust gas temperature associated with the regeneration process; and select a particular control process, from the plurality of control processes, based on determining that the exhaust gas temperature of the engine is greater than the particular exhaust gas temperature.

20. The non-transitory computer-readable medium of claim 15, wherein the one or more instructions, that cause the device to select the control process, of the plurality of control processes, cause the device to:

determine, based on the information concerning the speed of the engine, that the speed of the engine is within a particular engine speed range;

determine, based on the information concerning the fuel rate of the engine, that the fuel rate of the engine is greater than a maximum fuel rate threshold;

obtain information concerning an exhaust gas temperature of the engine based on determining that the speed of the engine is within the particular engine speed range and that the fuel rate of the engine is greater than the maximum fuel rate threshold;

determine that the exhaust gas temperature of the engine is less than a particular exhaust gas temperature associated with the regeneration process; and select a particular control process, from the plurality of control processes, based on determining that the exhaust gas temperature of the engine is less than the particular exhaust gas temperature.

* * * * *